US005893782A

United States Patent [19]

Harting et al.

[11] Patent Number: 5,893,782

[45] Date of Patent: Apr. 13, 1999

[54] SINGLE-POLE CONTACT SYSTEM

[75] Inventors: Dietmar Harting, Espelkamp; Herbert Junck, Lübbecke; Klaus Olejarz, Bad Oeynhausen, all of Germany

[73] Assignee: Harting KGaA, Germany

[21] Appl. No.: 09/058,993

[22] Filed: Apr. 13, 1998

[30] Foreign Application Priority Data

Apr. 29, 1997 [DE] Germany ..... 197 18 004

[51] Int. Cl.[6] ..... H01R 13/17

[52] U.S. Cl. ..... 439/827; 439/265

[58] Field of Search ..... 439/825, 827, 439/848, 889, 265

[56] References Cited

U.S. PATENT DOCUMENTS 3,644,869 2/1972 Newman .
4,374,607 2/1983 Bright et al. .
5,423,692 6/1995 Francis .

FOREIGN PATENT DOCUMENTS 616 387 A1 9/1994 European Pat. Off. .
7 192794 A 7/1995 Japan .

*Primary Examiner*—Steven L. Stephan
*Assistant Examiner*—Javaid Nasri
*Attorney, Agent, or Firm*—Dorn, McEachran, Jambor & Keating

[57] ABSTRACT

For a single-pole contact system for high currents, consisting of a rigid socket part (1) and a plug-in part (2) comprising elastic contact lamellae (16), it is proposed that the plug-in part (2) is provided with a pin-type projection (9), a cylindrical contact part (15), on which are fashioned elastic contact lamellae (16), is pushed on to the pin-type projection (9), the free ends of the contact lamellae pointing towards a conical transition (12) from the plug-in part (2) to the pin-type projection (9) and, at the front end of the projection, there is provided a pressure part (20) which acts on the contact part (15), the free ends of the contact lamellae (16) being pressed against the cone so that they are pressed radially outward, i.e., against the inside of the socket.

7 Claims, 3 Drawing Sheets

SINGLE-POLE CONTACT SYSTEM

The invention concerns a single-pole contact system for high currents, consisting of a rigid socket part and a plug-in part provided with elastic contact lamellae.

In the case of such contact systems for the transmission of high electrical currents, the construction must be designed so that the electrical resistance (volume resistivity) of the entire contact system is as low as possible, since the electrical resistance, in dependence on the current flow, is responsible for the heating of the contact in application. It must be possible for this low resistance to be maintained over the entire period of application of the contact. At the same time, an appropriate construction of the individual contact elements ensures that the mating of the socket and the pin effects a self-locking of the system which renders superfluous additional locking elements on the casings of the plug-and-socket connector.

Contact systems are known which are provided with special wire springs (wire spring contacts) or contact lamellae in the interior of the socket for the purpose of achieving a low contact resistance. As a result of these measures, a very large number of contact points are produced and, consequently, a low volume resistivity is developed. The locking system used is often the push-pull system. The production of wire springs or contact lamellae requires complex and costly tools. Final assembly necessitates a large amount of work.

The push-pull locking system requires additional parts (stop ring, slide ring) which likewise necessitate a high degree of precision in production and a large amount of assembly work. Due to the tools required for the production and assembly of the individual parts, the contacts can only be produced with a high level of financial expenditure (investment costs).

The object of the invention is to create a contact system for high currents which can be produced without a high expenditure of additional costs for special tools and expensive assembly devices. Wherever possible, only simple turned parts and available, low-cost DIN parts are to be used. No additional components are to be required for the locking system.

This object is achieved in that the plug-in part has a pin-type projection, in that a cylindrical contact part provided with slots is pushed on to the pin type projection, the slots being provided in the axial direction of the plug-in part and elastic contact lamellae being formed, in that the free ends of the contact lamellae point towards a conical transition from the plug-in part to the pin-type projection, and in that at the front end of the projection there is a pressure part which can act upon the contact part, the free ends of the contact lamellae being pressed against the cone so that they are pressed radially outwards, i.e., against the inside of the socket.

Advantageous embodiments of the invention are disclosed in claims 2 to 7.

The particular advantages achieved by the invention are, firstly, that connection by means of a form-fit closure (bead into groove) and force closure (contact force of contact lamellae on inside of socket and pin contact base body) means that there is no need for additional locking elements. An unintentional separation of the connection is possible only as the result of high tensile forces on the contact system. Such forces, however, do not occur either during normal operation or with high levels of vibration. Since high contact forces are achieved, there is a drastic reduction of the contact resistance and, consequently, self-heating is reduced.

Higher currents can be transmitted. All individual parts, apart from the pressure part, are simple turned parts which can be produced at low cost or they are available DIN parts which can likewise be procured at low cost. The pressure part can be produced simply and cost-effectively as a diecast part. The complete contact system has a small overall structural size.

An embodiment example of the invention is described more fully below and depicted in the drawing, wherein.

Figure 1:
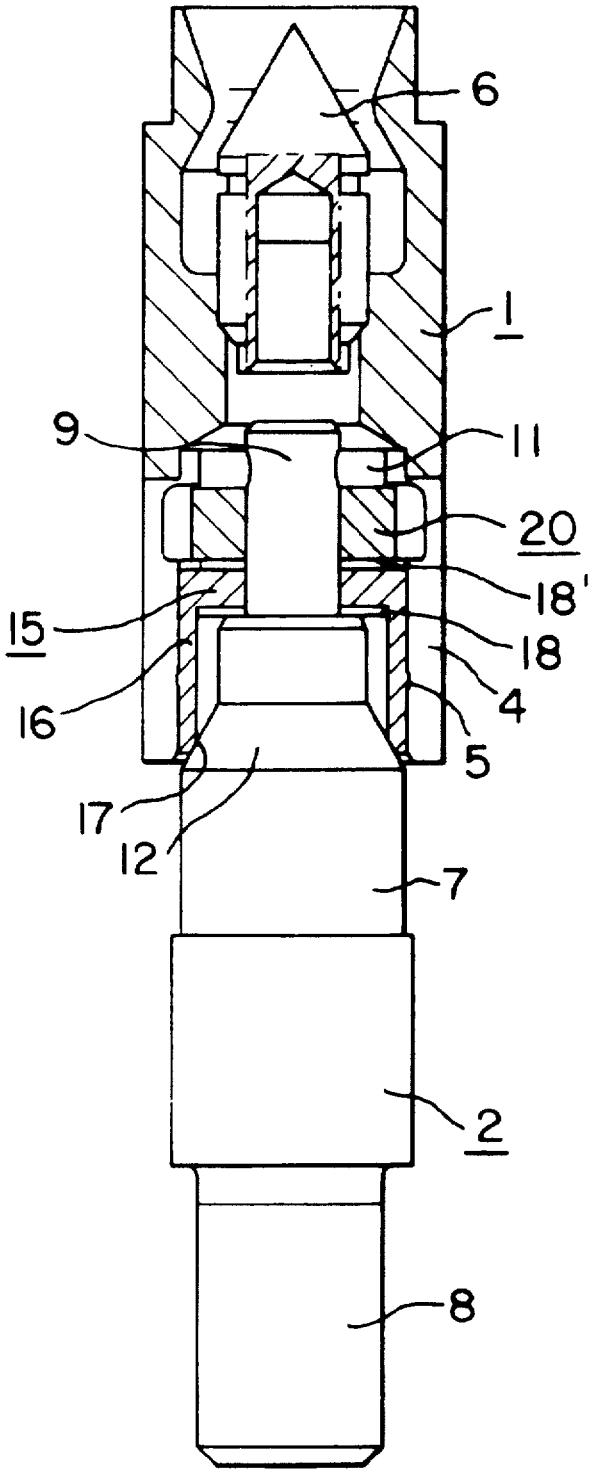
FIG. 1 shows a single-pole contact system.
Figure 2:
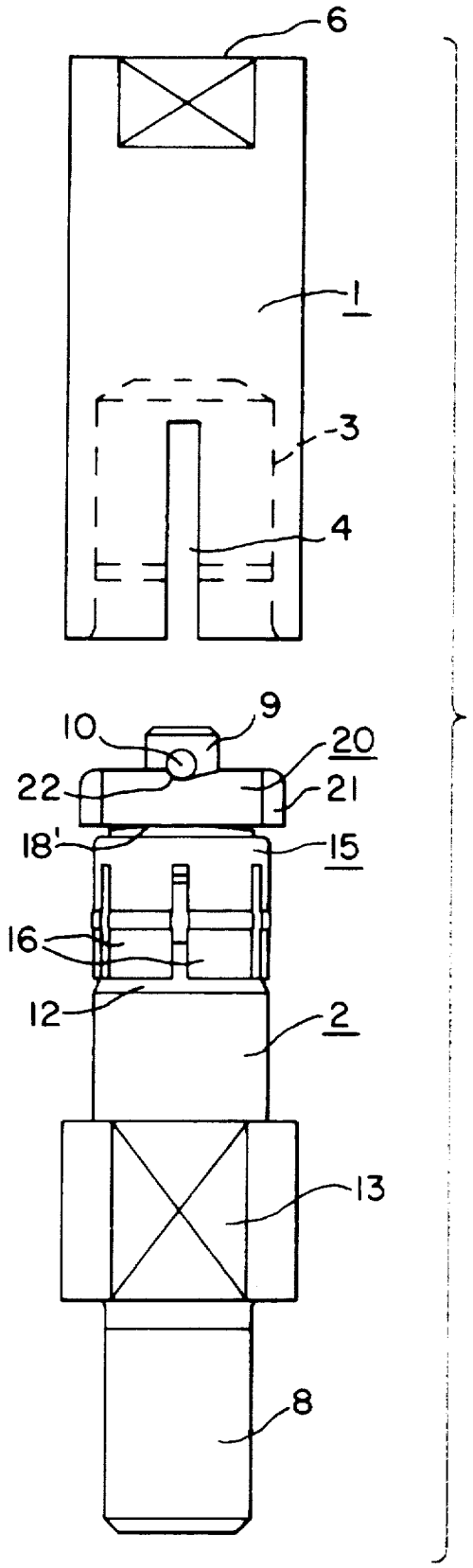
FIG. 2 shows a disassembled representation of the contact system of FIG. 1.
Figure 3:
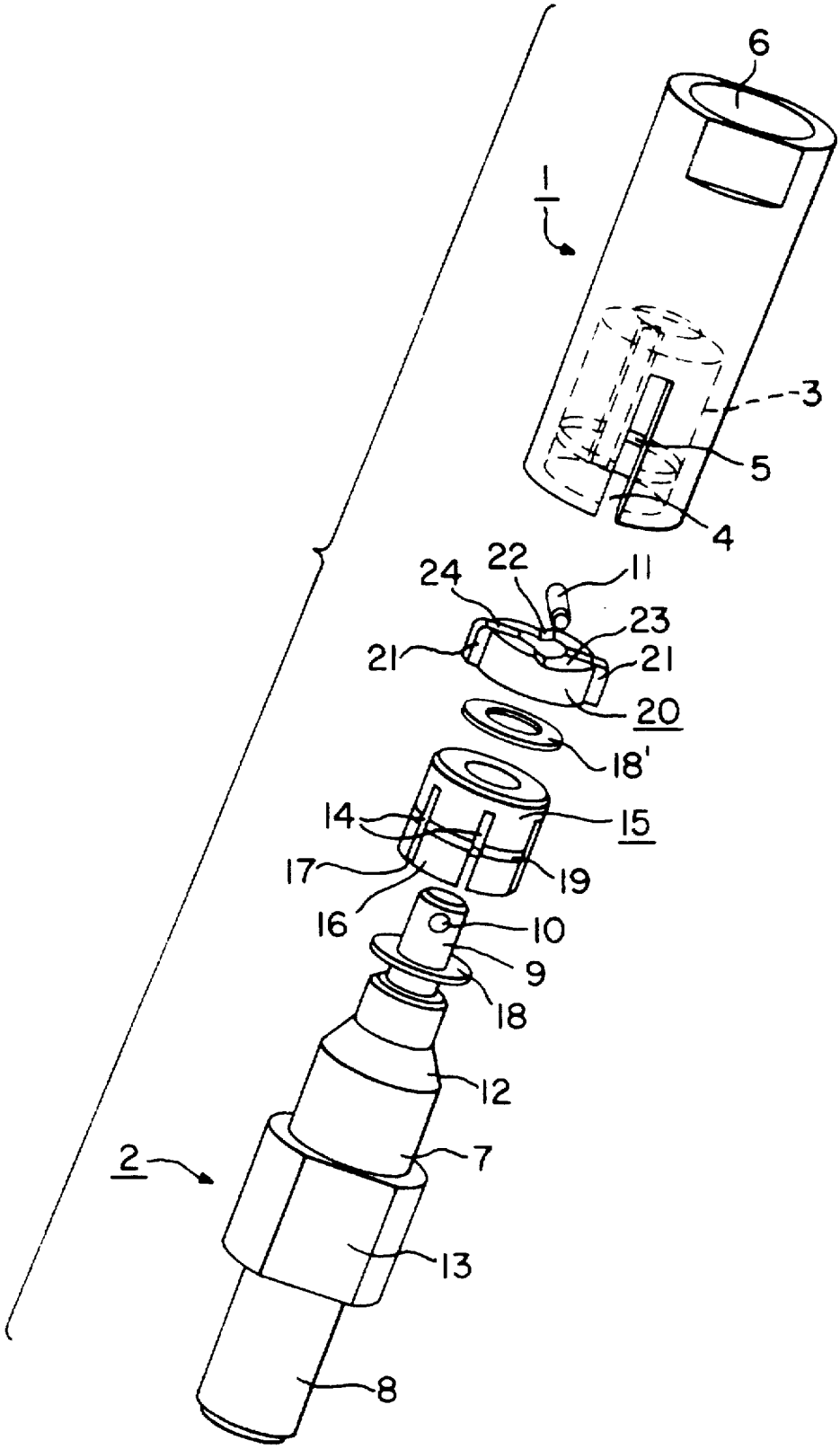
FIG. 3 shows a disassembled and perspective representation of the contact system of FIG. 1.

The contact system depicted in FIGS. 1 to 3 consists essentially of a socket part 1 and a plug-in part 2, which can be plugged into one another.

The plug-in region of the socket part comprises a bore 3 with 2 slots, the axial slots 4 being provided in this case. This type of socket is very solid and has only a slight spring action. At a certain depth of the bore 3, there is a shallow inner groove 5 of a certain width, the functioning of which is explained below. All known connection systems can be used for the purpose of connecting a conductor to the end opposite to the bore. In this case, it is an axial screw terminal 6.

The plug-in part 2 consists essentially of the base body 7 with any connection portion 8 and a stepped front portion 9 with a transverse bore 10 for accommodating a transverse pin 11, preferably a center-grooved dowel pin. Further towards the central portion, the pin again widens conically to a greater diameter, the cone 12 being formed here. The diameter becomes greater again before the connection portion 8 and, in this portion, comprises a dihedral element 13. In this case, the conductor connection 8 is in the form of a stud terminal.

Placed on the stepped end of the base body 7 is a contact part 15 comprising six slots 14 and a corresponding inner bore. The diameter of the bore is larger in the slotted portion, so that slightly elastic contact lamellae 16 are produced at that point. The outer end of the large bore comprises an inner chamfer 17. This portion is located over the cone 12 of the base body. On the inside of the bore of the contact part 15 there is a spring element 18, preferably a disc spring. This maintains a distance between the contact part and the conical portion of the base body, so that the contact lamellae 16 of the contact part do not yet bear on the cone 12 of the base body. They are still capable of springing inwards. This is necessary due to the fact that on the outside of the contact part, approximately in the center of the contact lamellae, there is a low encircling bead 19. The outer diameter of the bead is somewhat larger than the inner diameter of the bore 3 of the socket part 1. Located on the outer end face of the contact part 15, on the stepped end of the base body, is a further spring element 18', again preferably a disc spring. On the front portion 9 of the base body there is then a pressure part 20 which is secured by means of the transverse pin 11 which is pressed into the transverse bore 10 of the stepped end of the base body.

The pressure part is of a cylindrical shape, with an inner bore and two opposing outer ribs 21. On the end face there is a groove 22, offset by 90° relative to the ribs.

The indentations formed by the groove are joined, via a rising slide face 23, to two further recesses (notches) 24 on the end face. These are again offset by 90° relative to the original indentations and are thus located in the region of the outer ribs 21 of the contact part. They are of a lesser depth, so that there is a certain rise from the first pair of notches to the second pair of notches, offset by 90°. The socket part is placed on the plug-in part in such a way that the two ribs of the contact element engage in the two slots 4 of the socket.

OPERATION

The socket part can be plugged on without force to the point at which it meets the bead 19 of the contact part. The socket part must then be pushed on further with a certain amount of force, so that the contact lamellae 16 of the contact part spring slightly inwards and the socket part can be pushed on to the plug-in part until the bead of the contact part engages in the groove 5 on the inside of the socket.

At this point the ribs 21 are positioned in slots 4. Rotation of socket 1 in a counterclockwise direction through 90 degrees causes pressure part 20 to turn and pin 11, which is secured by front portion 9, will then move along slide faces 23 from groove 22 to notches 24 which will force pressure part 20 toward contact part 15 by the amount of the rise of the slide faces. This in turn pushes on contact part 15 causing lamellae 16 to engage cone 12 and expand.

Due to this slight backward movement of the contact part, the inner faces of the springing contact lamellae are in contact with the conical portion of the base body (cone 12) and move outwards on the latter. Their rear outer surfaces are now simultaneously in contact with the inside of the socket and are pressed against the latter. An inner contact is produced which is maintained by the compressed spring elements 18, 18' (disc springs).

We claim:

1. Single-pole contact system for high currents, consisting of a rigid socket part and a plug-in part provided with elastic contact lamellae, characterized in that the plug-in part (2) has a pin-type projection, in that a cylindrical contact part (15) provided with slots (14) is pushed on to the pin-type projection, the slots being provided in the axial direction of the plug-in part and elastic contact lamellae (16) being formed, in that the free ends of the contact lamellae point towards a conical transition from the plug-in part to the pin-type projection, and in that at the front end of the projection there is a pressure part (20) which can act upon the contact part (15), the free ends of the contact lamellae (16) being pressed against the cone (12) so that they are pressed radially outwards, against the inside of the socket.

2. Single-pole contact system according to claim 1, characterized in that the pressure part (20) is secured against slippage from the projection by means of an end transverse pin (11) on the end of the projection.

3. Single-pole contact system according to claim 2, characterized in that the transverse pin (11) acts on an oblique surface of the pressure part (20), the transverse pin being axially displaced when the pressure part is twisted relative to the transverse pin.

4. Single-pole contact system according to claim 1, characterized in that the pressure part (20) has at least one rib (21) which engages in a correspondingly dimensioned axial slot (4) of the socket part (1) when the plug-type parts are joined.

5. Single-pole contact system according to claim 1, characterized in that the end face of the pressure part (20) has a radial groove (22) in which the transverse pin (11) engages when the locking position is attained.

6. Single-pole contact system according to claim 1, characterized in that the contact part (15) has an encircling annular bead (19) in the region of the outside of the contact lamellae and in that the socket part (1) has an inner groove (5) in which the bead engages when the plug-type parts are joined.

7. Single-pole contact system according to claim 2, characterized in that the axial play of the contact part (15) is limited by spring elements (18, 18') disposed on either side, the free ends of the contact lamellae (16) not coming into contact with the cone (12) in the initial position.

* * * * *